United States Patent [19]

Iverlund et al.

[11] Patent Number: 4,485,564

[45] Date of Patent: Dec. 4, 1984

[54] METHOD OF CARRYING OUT THE DRYING OF WOODEN OBJECTS

[75] Inventors: Bertil G. Iverlund, Arvika; Per Olov G. Risman, Huskvarna; Hans G. Uddborn, Arvika, all of Sweden

[73] Assignee: Aktiebolaget Edane Komponenter, Edane, Sweden

[21] Appl. No.: 403,516

[22] PCT Filed: Nov. 10, 1981

[86] PCT No.: PCT/SE81/00329

§ 371 Date: Jul. 6, 1982

§ 102(e) Date: Jul. 6, 1982

[87] PCT Pub. No.: WO82/01766

PCT Pub. Date: May 27, 1982

[30] Foreign Application Priority Data

Nov. 14, 1980 [SE] Sweden ..... 8008033
Sep. 14, 1981 [SE] Sweden ..... 8105457

[51] Int. Cl.[3] ..... F26B 3/34

[52] U.S. Cl. ..... 34/1; 34/68; 34/13.8

[58] Field of Search ..... 34/1, 68, 46, 77, 17, 34/18, 27, 13.4, 13.8; 219/10.55 R, 10.55 M

[56] References Cited

U.S. PATENT DOCUMENTS 2,617,202 11/1952 Reedy ..... 34/13.8
3,721,013 3/1973 Miller ..... 34/1
3,845,270 10/1974 Widugris, Jr. ..... 219/10.55 R

FOREIGN PATENT DOCUMENTS

WO81/00303 4/1982 PCT Int'l Appl. .

*Primary Examiner*—Larry I. Schwartz
*Attorney, Agent, or Firm*—Alfred E. Miller

[57] ABSTRACT

A method of drying wooden objects according to the invention shall be carried out in a closed treatment room (10) with a supply of microwave effect which heats the objects stacked in a unit so that the moisture is pressed out and removed. Each unit is positioned in a cover of heat insulation stuff which prevents cooling of the wooden objects by the air circulation in the room.

6 Claims, 2 Drawing Figures

METHOD OF CARRYING OUT THE DRYING OF WOODEN OBJECTS

Figure 1:
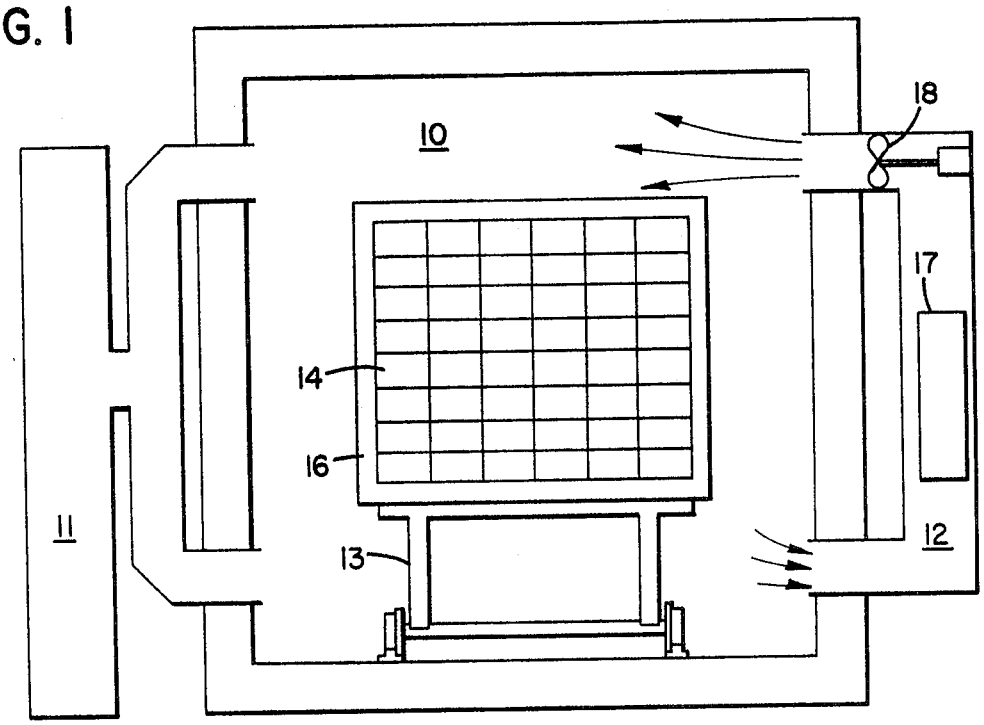

The present invention is related to a method of drying wood in the shape of boards, planks, etcetera.

A well-known method of drying timber is carried out by exposing the timber to dry hot-air currents which suck out the moisture of the wood. During such a procedure the surfaces of the wooden objects will dry first so that the thin capillaries in the wood which keep the moisture will shrink at the surface and obstruct further transfer of moisture out of the wood. In such a well-known procedure (e.g. Swedish patent publication No. SE 319 129) the hot-air drying is completed with a high frequency treatment of the wood. By such high frequency heating it is possible to achieve a temperature gradient in the load which is positive in the direction from the surface to the centre of the load. As the heat is then generated in the wood it is necessary to provide air to cool the wood in order to create a temperature balance. The moisture is then pressed out instead of being sucked out as in the case of conventional hot-air drying when the temperature gradient is oppositely directed. The high frequency treatment according to the well-known procedure provides, however, just a partial advantage to the conventional drying. Some improvements of the procedure are achieved by the use of microwave heating for the drying. (1) The saving of time by microwave heating can be essential; the drying period is often reduced to 20% of the corresponding period of hot-air drying. (2) The microwaves are self-adjusting i.e. the drier parts of the load absorb less effect than the moister ones. (3) The microwave drying gives a higher quality due to the fact that the occurrence of cracking and wrappedness is practically eliminated as both the temperature and the mositure gradients are essentially less than in the case of other drying methods. (4) The treatment costs are considerably reduced by microwave drying due to the fact that a laying of bed laths is eliminated and the improvement of quality allows a simplification of the subsequent manufacturing procedures. (5) Much less energy consumption is a consequence of the use of microwaves, primarily owing to the fact that no need exists for heating air separately, that the air temperature in the drying room is lower and thus the heat dissipation less, that the drying period is shorter and that the power of ventilators is reduced as the air circulation is used just for removing the moisture, not for blowing air on the timber to suck out the mositure as in the case of hot-air drying.

In carrying out the method according to the invention a closed microwave-tight room with dimensions in all directions exceeding some four microwave wave lengths and a microwave generator with feeding devices are needed. The load is positioned in the room in the form of a packeted, heat insulated wooden product on a stand or a carriage. The insulation is made of a moisture- and microwave-transparent material and the cross-section areas of the load inside the insulation in any direction may be of a value of some penetration depths at most of the used microwave frequency. When the frequency is for instance 915 MHz this measure will be about 1 meter. The microwaves penetrate the insulation without attenuation and are absorbed in the load. Thanks to this an even drying is achieved which is lenient and bring about great technical advantages owing to reduced occurrence of cracking and warping in the wood.

A preferred embodiment of a method according to the invention is described in the following as carried out in a treatment room which is shown in a vertial cross-section on the drawing.

Figure 2:
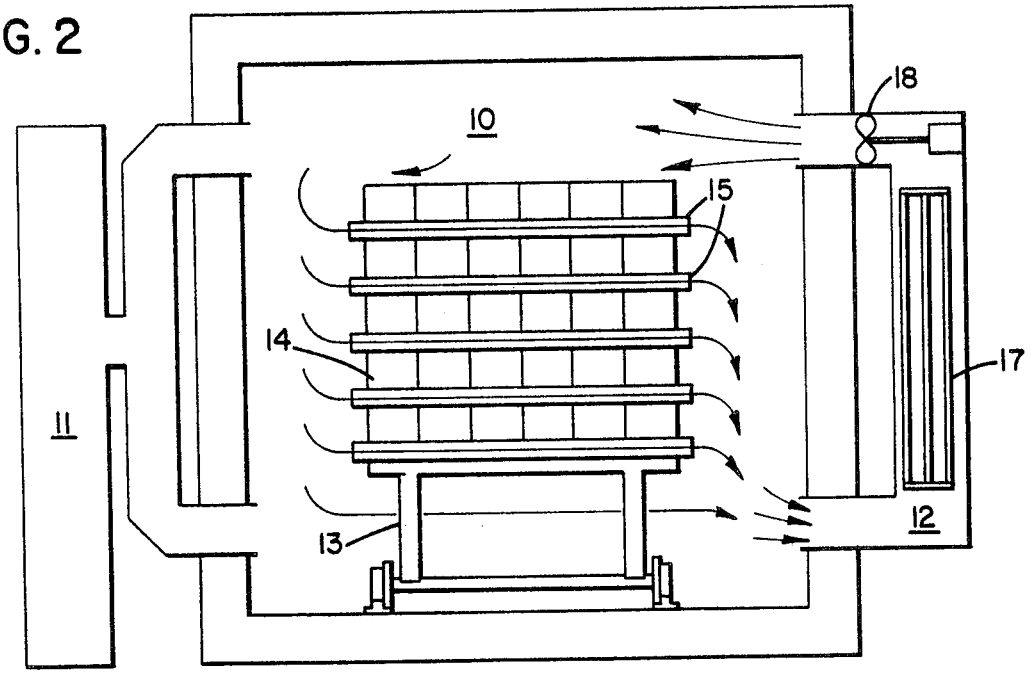

FIG. 1 shows a room in which the load is the said insulated wooden product and FIG. 2 a room in which a stack of timber is treated.

The physical quantities to be used in carrying out a method here referredto are microwave effect, temperature and time, in addition condensation of moisture is assumed to be provided. Microwave effect is supplied from a microwave generator which works in an established frequency range. Condensation is achieved by means of a cooling apparatus and a ventilator arrangement. The procedure is carried out in a treatment room 10 to which a microwave source 11 and an air circulation system 12 are connected. There is also a carrier 13 for a load 14 to be treated in the room. The inner walls of the room are designed for a high reflection of microwaves and a good sealing to the environment so that the waves cannot leak out. The load is disposed in a parcel (FIG. 1) or stacked (FIG. 2) on the carrier which in the shown embodiment is a carriage of preferably dry wood with wheels of metal. The distance from the wheels to the load need to be a couple of vacuum wavelengths in order not to make the distortions in the field from the metal objects dominating. The carriage is used for moving the load into and out of the treatment room. If other conveying means are used the carrier can be a common stand. The wooden objects (FIG. 1) shall be in close contact with each other as a sufficient vaporization still occurs and the moisture is removed by the air circulation. The microwave heating is self-adjusting in the way that drier parts of the load absorb less effect than moist parts. The objects can be kept together by bands or in other ways exposed to a pressure in order to further reduce the warpedness of the dried product. If certain parts of the road have uneven moisture this will be equilibrated during the drying procedure. Closely packed objects are during the heating heated to a higher temperature than freely strayed objects which would be cooled individually by the air circulation. The wooden surfaces are protected from the cooling air circulation by an insulation cover 16 around the wooden objects. Thanks to this a more even temperature and moisture gradient is achieved which makes it possible to obtain a higher quality, reduces the energy consumption of the drying process owing to smaller heat dissipation to the environment and allows the use of a higher wood temperature than what is used in conventional drying. The moisture of the wood is evaporated more rapidly at the obtained higher temperature, penetrates the insulation and is removed by the air current. Owing to the fact that the moisture is evaporated more rapidly the treatment time will be shorter and the procedure more economic.

The separate objects (FIG. 2) of the load can be positioned at a distance from each other so that opening gaps and hence air space are formed in the load. Such opening gaps can be established by putting laths (bed laths) 15 between the layers of boards or the like when these are piled up. The opening gaps establish air channels in the load which is thus thoroughly aired when the ventilator is working.

The relative humidity in the air is high (typically more than 80%) but to make the air continuously absorb vapour, the system is provided with a condensating apparatus in the form of a cooling element 17. As the circulation system is closed the same air is conducted in a circuit between the load and the cooling element. The air circulates at a low speed since the air current should just remove moisture, a relatively small ventilator 18 can thus be used.

The insulation material mentioned above should have the property of letting vapour through. The choice of one of several such materials should be made case by case, as an example it is noted that packing material in the form of undulated cardboard boxes has a sufficient heat insulating capacity in combination with diffusibility. As an example of wooden objects packed and dried in boxes with those properties furniture details and parquet blocks are mentioned. The drying procedure is then the last step in a manufacturing process which thanks to this method can be shortened and simplified.

We claim:

1. In the method of drying wood objects by subjecting the objects to microwave energy in a treatment space while circulating air in said space, the improvement comprising covering said objects with a cover of a heat insulating material that is transparent to moisture and to said microwave energy, whereby said objects are separated from said circulating air.

2. The method of claim 1 wherein said step of circulating air comprises propelling air in a circuit between a cooling element and said treatment space without connection with the atmosphere outside of said space, whereby water removed from said objects by the circulating air condenses on said cooling element.

3. The method of claim 1 further comprising maintaining the temperature of the circulating air to be lower than that of the wooden objects.

4. A method for drying wooden objects comprising the steps of:

(a) stacking said wood objects close to each to form a unit;

(b) covering said unit with a cover of a heat insulating material which is transparent to microwaves and water vapor;

(c) pushing said covered unit in a microwave treatment room;

(d) supplying microwave energy to said treatment room; and (e) circulating air in said treatment room externally of said cover.

5. The method of claim 4 wherein said step of circulating comprises propelling air in a circuit between a cooling element and said unit without connection with the atmosphere outside of said treatment room, whereby water removed from said unit by said circulating air condenses on the cooling element.

6. The method of claim 4 wherein said step of circulating comprises maintaining the temperature of circulating air in said treatment room to be lower than that of said wood objects.

* * * * *